US009042759B2

(12) United States Patent
Nakamoto

(10) Patent No.: US 9,042,759 B2
(45) Date of Patent: May 26, 2015

(54) IMAGE FORMING APPARATUS

(71) Applicant: CANON KABUSHIKI KAISHA, Tokyo (JP)

(72) Inventor: Ikuo Nakamoto, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 63 days.

(21) Appl. No.: 14/037,209

(22) Filed: Sep. 25, 2013

(65) Prior Publication Data

US 2014/0086609 A1 Mar. 27, 2014

(30) Foreign Application Priority Data

Sep. 27, 2012 (JP) ..... 2012-213568

(51) Int. Cl.
*G03G 15/00* (2006.01)
*G03G 15/20* (2006.01)
*G03G 15/23* (2006.01)

(52) U.S. Cl.
CPC ..... *G03G 15/2028* (2013.01); *G03G 15/235* (2013.01); *G03G 15/6594* (2013.01); *G03G 2215/00514* (2013.01); *G03G 2215/2045* (2013.01)

(58) Field of Classification Search
CPC ..... G03G 2215/00514; G03G 15/2028; G03G 2215/2045
USPC ..... 399/68
See application file for complete search history.

(56) References Cited

FOREIGN PATENT DOCUMENTS

JP 5-224551 A 9/1993

*Primary Examiner* — Walter L Lindsay, Jr.
*Assistant Examiner* — Ruth LaBombard
(74) *Attorney, Agent, or Firm* — Canon U.S.A. Inc., IP Division

(57) ABSTRACT

An image forming apparatus that sets a second conveyance speed, at which a recording material is conveyed at a heating nip portion, higher than a first conveyance speed, at which the recording material is conveyed at a transfer nip portion, conveys an envelope by the transfer and heating nip portions without transferring a toner image at the transfer nip portion. After that, the image forming apparatus which sets the second conveyance speed equal to or lower than the first conveyance speed transfers the toner image formed on a photosensitive drum acting as an image bearing member onto the envelope conveyed again to the transfer nip portion by a reversing conveyance mechanism acting as a re-conveyance unit to fix the toner image on the envelop at the heating nip portion.

15 Claims, 6 Drawing Sheets

IMAGE FORMING APPARATUS

BACKGROUND

1. Field

Aspects of the present invention generally relate to an image forming apparatus, such as a printer, a copying machine, a facsimile machine, and a multifunction peripheral including a plurality of those functions.

2. Description of the Related Art

An image forming apparatus forms (transfers) an image onto a recording material and fixes the image to the recording material by a fixing device. If an envelope is used as the recording material and heated and pressed in the same manner as plain paper, the envelope may crease.

Japanese Patent Application Laid-Open No. 5-224551 discusses a technique, in which a conveyance speed of the envelope is set higher in a fixing unit than in a transfer unit and the envelope is conveyed while being pulled between the transfer unit and the fixing unit, thereby the technique suppresses the occurrence of creases. If an image is to be formed on an envelope, the user firmly presses and rubs the envelope in advance to suppress the occurrence of creases, which has been known up until now.

As discussed in Japanese Patent Application Laid-Open No. 5-224551, if the envelope is conveyed while being pulled between the transfer unit and the fixing unit, image misregistration may occur in the transfer unit. It is also troublesome for the user to surely rub the envelope one by one and such a measure is not effective.

SUMMARY

Aspects of the present invention are generally directed to an image forming apparatus capable of suppressing the occurrence of creases on an envelope and the occurrence of a defective image.

According to an aspect of the present invention, an image forming apparatus includes an image forming unit configured to form an image on a recording material while the image forming apparatus nips and conveys the recording material at a first nip portion, a fixing unit configured to fix the image formed on the recording material by the image forming unit while the fixing unit nips and conveys the recording material at a second nip portion, a re-introduction unit configured to re-introduce the recording material, which has passed through the second nip portion, into the first nip portion, and a control unit configured to control an operation of the image forming unit and the fixing unit, wherein, if an envelope is used as the recording material, the control unit executes a primary operation in which the recording material is introduced to the first and second nip portions without the image forming unit forming an image on the envelope, and then executing a secondary operation in which the re-introduction unit re-introduces the envelope into the first and second nip portions and the image forming unit forms an image on the envelope, and wherein the control unit controls a conveyance speed of the envelope at the second nip portion to be set higher than the conveyance speed of the envelope at the first nip portion in the primary operation, and the control unit controls the conveyance speed of the envelope at the second nip portion to be set equal to or lower than the conveyance speed of the envelope at the first nip portion in the secondary operation.

Further features of the present disclosure will become apparent from the following description of exemplary embodiments with reference to the attached drawings.

DESCRIPTION OF THE EMBODIMENTS

The accompanying drawings, which are incorporated in and constitute a part of the specification, illustrate exemplary embodiments, features, and aspects of the disclosure.

Figure 2:
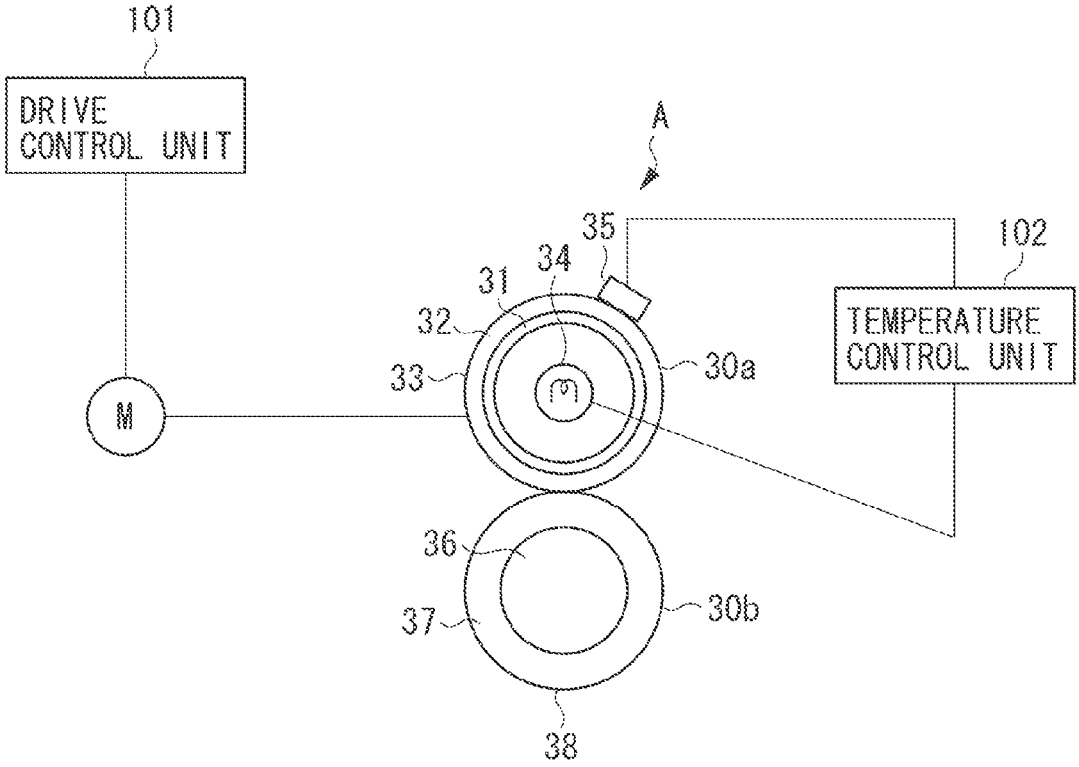
FIG. 2 is a cross section illustrating a schematic configuration of a fixing device according to the first exemplary embodiment.
Figure 3:
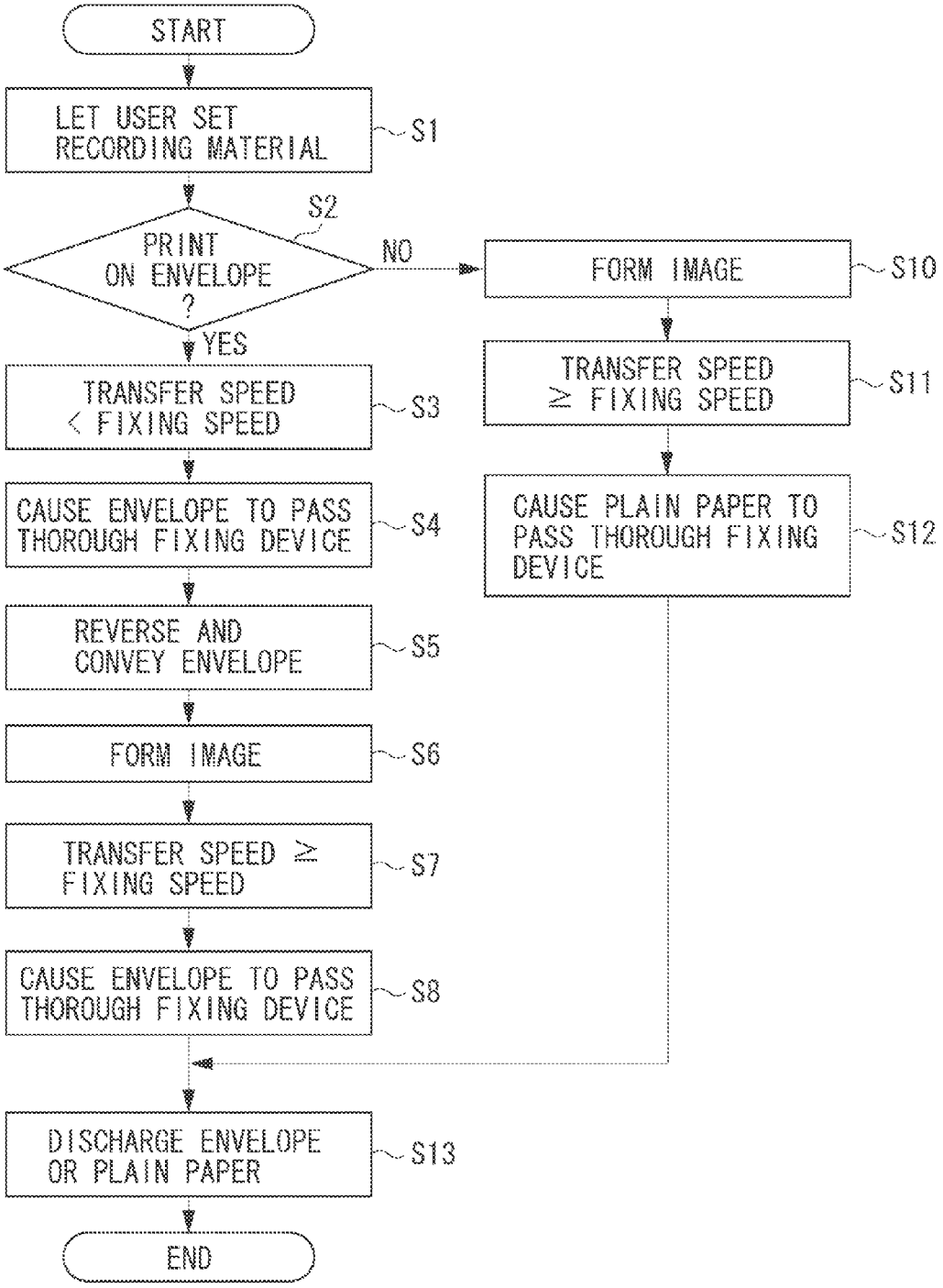
FIG. 3 is a flow chart illustrating an example of flow of control according to the first exemplary embodiment.

A first exemplary embodiment is described with reference to FIGS. 1 to 3. A schematic configuration of an image forming apparatus according to the present exemplary embodiment is described with reference to FIG. 1.

[Image Forming Apparatus]

Figure 1:
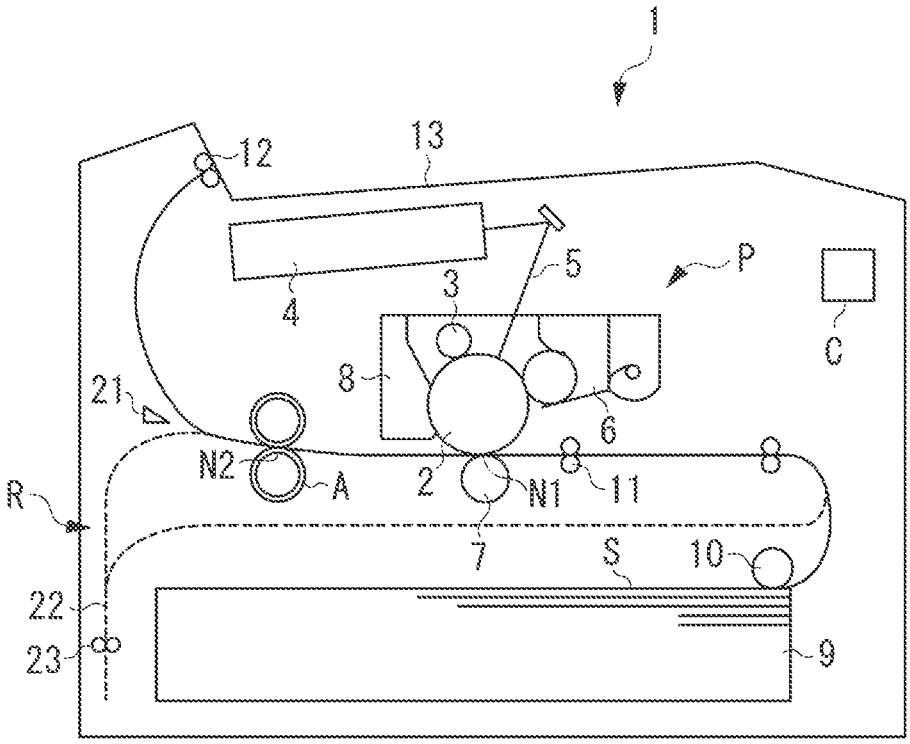
FIG. 1 is a cross section illustrating a schematic configuration of an image forming apparatus according to a first exemplary embodiment.

An image forming apparatus 1 illustrated in FIG. 1 is an image forming apparatus (a printer) with an electrophotographic method. The image forming apparatus 1 mainly includes a toner image formation unit P acting as an image forming unit, a transfer roller (a transfer mechanism) 7, a fixing device A acting as a fixing unit, and a reversing conveyance mechanism R acting as a re-introducing unit. The toner image formation unit P forms a toner image on an image bearing member. For this reason, the toner image formation unit P is equipped with the following devices. A charger 3 acting as a charge unit is provided around a photosensitive drum 2 acting as the image bearing member. The charger 3 uniformly charges the surface of the photosensitive drum 2. An exposure apparatus 4 acting as an exposure unit irradiates the photosensitive drum 2 with a light beam 5 based on the image to form an electrostatic latent image on the photosensitive drum 2. The electrostatic latent image is developed by a developer 6 acting as a developing unit and a toner image is formed on the photosensitive drum 2 (the image bearing member).

A recording material S such as s sheet and paper is stored in a feeding cassette 9 under the apparatus and fed by a feeding roller 10. The recording material S is conveyed by a registration roller pair 11 in synchronization with the toner image on the photosensitive drum 2.

The transfer roller 7 acting as a transfer member is capable of transferring the toner image formed on the photosensitive drum 2 by the toner image formation unit P onto the recording material S. The transfer roller 7 and the photosensitive drum 2 that are a pair of rotating members to form a transfer nip portion (a first nip portion) N1 which can nip the recording material S therebetween and convey the recording material S. The application of a predetermined transfer bias to between the transfer roller 7 and the photosensitive drum 2 enables electro-statistical transfer of the toner image formed on the photosensitive drum 2 onto the recording material S, which is conveyed by the registration roller pair 11 in synchronization with the toner image, at the transfer nip portion N1. Toner remaining on the photosensitive drum 2 is removed by a cleaning device 8 acting as a cleaning unit.

The recording material S onto which the toner image is transferred is conveyed to the fixing device A. The fixing device A capable of heating the recording material S at a heating nip portion (a fixing nip portion) N2 heats and presses the toner image formed on the recording material S at the heating nip portion N2 to fix the toner image to the recording material S. The recording material S to which the toner image is fixed is conveyed and discharged to a discharge tray 13 over the apparatus by a discharge roller pair 12.

If an image is to be formed on both sides of the recording material S, the reversing conveyance mechanism R reverses the recording material S having passed the heating nip portion N2 and conveys the recording material S again to the transfer nip portion N1. In other words, the reversing conveyance mechanism R is a reversing conveyance unit that interchanges the leading edge with the trailing edge of the recording material S in the conveyance direction to reverse the front and back sides of the recording material S and conveys the recording material S again to the transfer nip portion N1. More specifically, the reversing conveyance mechanism R drives a conveyance path switching guide 21 and guides the recording material S discharged from the fixing device A to a reversing path 22. A reversing roller 23 provided on the reversing path 22 is reversely rotated to cause the recording material S to leave the reversing path 22 with the trailing edge of the recording material S pulled into the reversing path 22, taken as the leading edge in the direction opposite the direction in which the recording material S has been pulled into the reversing path 22. Thereafter, the toner image formed on the photosensitive drum 2 by the above similar image forming process is transferred again onto the other side of the recording material S and the toner image is fixed to the recording material S by the fixing device A. The recording material S to which the toner image is fixed is conveyed and discharged to the discharge tray 13 over the apparatus by the discharge roller pair 12, similarly to the above description.

[Fixing Device]

The fixing device A is described in detail below with reference to FIG. 2. The fixing device A has a pair of rotating members, in other words, a fixing roller 30*a* acting as a heating member and a pressure roller 30*b* acting as a nip forming member which forms the heating nip portion (a second nip portion) N2 capable of nipping the recording material S with the fixing roller 30*a* and conveying the recording material S. The heating nip portion N2 can heat the recording material S. The fixing device A is arranged more downstream than the transfer nip portion N1 in the direction in which the recording material S is conveyed, and in a position where the length of a recording material conveyance path between the heating nip portion N2 and the transfer nip portion N1 is shorter than the length in the direction in which a predetermined recording material (an envelope, for example, described below) is conveyed.

The fixing roller 30*a* to contact a toner image on the recording material S is configured such that an elastic layer 32 is provided on a core 31 and a release layer 33 covers the elastic layer 32. The core 31 is made of iron, which is hollow, and 0.5 mm in thickness, for example. The elastic layer 32 is made of 0.8 mm thick silicon rubber layer, for example. The release layer 33 is made of 30 μm thick tetrafluoroethylene perfluoroalkylvinylether copolymer (PFA) tube layer, for example. The fixing roller 30*a* is 30 mm in diameter, for example. A halogen heater 34 acting as a heating unit is arranged in the fixing roller 30*a*.

A thermistor 35 acting as a temperature detection unit is arranged in the vicinity of the fixing roller 30*a* and at the center portion in an axial direction of the fixing roller 30*a*. The thermistor 35 inputs a signal indicating the surface temperature of the fixing roller 30*a* to a temperature control unit 102. The temperature control unit 102 receiving the signal controls (turns on/off) energization to the halogen heater 34 so that the surface temperature of the fixing roller 30*a* is maintained at a predetermined fixing temperature (170° C. in the present exemplary embodiment).

The pressure roller 30*b* is configured such that an elastic layer 37 is provided on a core 36 and a release layer 38 covers the elastic layer 37. The core 36 is made of solid iron, for example. The elastic layer 37 is made of 5 mm thick silicon rubber layer, for example. The release layer 38 is made of 30 μm thick PFA tube layer, for example. The pressure roller 30*b* is 30 mm in diameter, for example.

The fixing roller 30*a* is rotationally driven by a drive motor M, which is connected to the end of the core 31. The drive motor M is a pulse motor. A drive control unit 101 controls the number of pulses of the pulse motor to control the rotation speed thereof. An encoder may be provided on the rotational axis of the drive motor M or the core 31 to control the rotation speed of the drive motor M by the signal of the encoder. In this case, the drive motor M may be formed by an alternate current (AC) servo motor instead of the pulse motor. The fixing roller 30*a* and the pressure roller 30*b* are pressed and contacted with each other by a pressure mechanism such as a spring under a total pressure of about 30 kg to form the heating nip portion N2. The fixing roller 30*a* is rotationally driven by the drive motor M at a circumferential speed of 160 mm/sec, for example. The pressure roller 30*b* is driven to rotate by the fixing roller 30*a*.

In the fixing device A, the recording material S bearing the toner image on the surface thereof is nipped and conveyed between the fixing roller 30*a* and the pressure roller 30*b* at the heating nip portion N2, and pressed and heated, thereby the toner image is fixed to the recording material S.

[Crease Suppression Mode]

In the present exemplary embodiment, a crease suppression mode is provided to suppress the occurrence of creases in a case where an image is formed on a bag-like body, acting as a predetermined recording material, whose plural sheet portions are superposedly formed. The following describes control operation for forming an image on an envelope as the bag-like body.

In the crease suppression mode, a second conveyance speed (fixing speed) at which the recording material is conveyed at the heating nip portion N2 is set higher than a first conveyance speed (transfer speed) at which the recording material is conveyed at the transfer nip portion N1. In this state, the envelope is conveyed between the transfer nip portion N1 and the heating nip portion N2 without the toner image being transferred thereon at the transfer nip portion N1. At this point, the envelope is conveyed between the transfer nip portion N1 and the heating nip portion N2 while being pulled.

Thereafter, the fixing speed (the second conveyance speed) is set equal to or lower than the transfer speed (the first conveyance speed) and the envelope is conveyed again to the transfer nip portion N1 by the reversing conveyance mechanism R acting as a re-conveyance unit. At this point, the toner image formed on the photosensitive drum 2 is transferred onto the envelope and the toner image is fixed to the recording material at the heating nip portion N2. In any conveyance state, the nip pressure of the transfer nip portion N1 is set to a normal pressure. In other words, the nip pressure of the transfer nip portion N1 is not lowered even in the first conveyance.

In the present exemplary embodiment, such control is performed by a control portion C (FIG. 1) acting as a control unit. The control portion C controls the above toner image formation unit P, the conveyance of the recording material, the transfer speed, and the fixing speed. In the present exemplary embodiment, the control portion C makes the fixing speed variable at the heating nip portion N2 via the drive control unit 101 to enable the setting of a relationship with the above transfer speed. The control portion C can also control the fixing temperature via the temperature control unit 102. The transfer speed substantially corresponds to the circumferential speed of the transfer roller 7 (the photosensitive drum 2). The fixing speed is substantially corresponds to the circumferential speed of the fixing roller 30*a* (the pressure roller 30*b*).

A specific example of the control is described below with reference to FIG. 3. In step S1, in a state where the fixing device A waits at a predetermined regulated temperature, a user selects either of the modes, in which plain paper or an envelope passes through the fixing device A, using an operation unit (not illustrated).

In a plain paper mode in which the plain paper passes (NO in step S2), in step S10, an image formation is started at print start. In step S11, the control portion C sets the fixing speed at the heating nip portion N2 equal to or lower than the transfer speed at the transfer nip portion N1. Thus, the fixing speed is set equal to or lower than the transfer speed not to pull the paper between the transfer nip portion N1 and the heating nip portion N2, which does not cause image misregistration when the image is transferred at the transfer nip portion N1. The fixing speed is set lower by 1.5% than the transfer speed. In step S12, the plain paper to which the toner image is transferred at the transfer nip portion N1 is conveyed to the fixing device A, which is rotationally driven at the fixing speed slower than the transfer speed at the transfer nip portion N1. The transferred toner image is heated and pressed to be fixed. In step S13, the plain paper to which the toner image is fixed is discharged to the discharge tray 13 by the discharge roller pair 12.

In an envelope mode (the crease suppression mode) in which the envelope passes, a secondary operation is conducted following a primary operation. More specifically, in step S1, the user sets the envelope on the image forming apparatus 1 such that a non-print surface can be a normal print surface, in other words, an image formation surface is on the side opposite the side where an image is to be transferred when the recording material first passes. If the envelope is set (YES in step S2), in step S3, the control portion C does not form an image at print start and performs setting so that the fixing speed at the heating nip portion N2 becomes faster than the transfer speed at the transfer nip portion N1. The fixing speed is set higher by 1.5% than the transfer speed. It is desirable that the increasing rate of the speed is greater than 0% and equal to or smaller than 10% (the fixing speed is taken as being 1.1 times or less the transfer speed). It is more desirable that the increasing rate is equal to or greater than 1% and equal to or smaller than 5% (the fixing speed is taken as being 1.01 times or more and 1.05 times or less the transfer speed).

In the primary operation, in step S4, if the envelope conveyed without the toner image having been transferred thereto at the transfer nip portion N1 passes thought the fixing device A, the fixing speed is faster than the transfer speed, so that the envelope is conveyed while being pulled between the transfer nip portion N1 and the heating nip portion N2. Thus, the envelope passes through the fixing device A while being pulled to correct distortion on the front and back surfaces of the envelope, which suppresses the occurrence of creases. At this point, the toner image is not transferred to the envelope at the transfer nip portion N1, so that image misregistration is not caused.

At this point, a rub effect releases air from the envelope having pressed by the fixing device A and having passed therethrough, and presses a fold line to bring the front and back surfaces into close contact with each other. If the corner of the envelope is deformed, it is corrected. Thereafter, the surface of the envelope is reversed by the reversing conveyance mechanism R. In the secondary operation, in step S5, the envelope is fed again to the transfer nip portion N1. In the secondary operation, similarly to the case of the plain paper, in step S6, image formation is started. In step S7, the fixing speed is set equal to or lower than the transfer speed at the transfer nip portion N1. The fixing speed is set lower by 1.5% than the transfer speed. In step S8, the envelope to which the toner image is transferred at the transfer nip portion N1 is conveyed to the fixing device A which is rotationally driven at the fixing speed slower than the transfer speed, and the transferred toner image is heated and pressed to be fixed. At this point, the envelope has been rubbed while passing through the fixing device A to suppress the occurrence of creases. In step S13, the envelope to which the toner image is fixed is discharged to the discharge tray 13 by the discharge roller pair 12.

In the above description, the fixing speed is lowered by 1.5% when the toner image is transferred onto the envelope or the plain paper at the transfer nip portion N1. However, a loop-amount control may be performed by providing a sensor for detecting the loop amount of the recording material between the transfer nip portion N1 and the heating nip portion N2. The loop-amount control is a method in which a deflection amount of the recording material is detected between the transfer nip portion N1 and the heating nip portion N2 and the fixing speed is varied so that the deflection amount is maintained within a predetermined range. Thereby, the recording material is not pulled between the transfer nip portion N1 and the heating nip portion N2 to enable prevention of image misregistration at the time of transferring the toner image.

In the present exemplary embodiment, as described above, with the fixing speed set higher than the transfer speed, the envelope is conveyed at the transfer nip portion N1 and the heating nip portion N2 and pulled between the transfer nip portion N1 and the heating nip portion N2. This allows suppression of the occurrence of creases in the envelope. Furthermore, the envelope is pressed by the fixing device A and passes therethrough while being pulled between the transfer nip portion N1 and the heating nip portion N2. Thus, the front and back surfaces of the envelope can be brought into close contact with each other while air inside the envelope is released. This allows suppression of the opening of the front and back surfaces and the occurrence of creases in the envelope due to deformation when the envelope passes in the secondary operation in which the toner image is heated and pressed to be fixed.

At this point, the toner image is not transferred at the transfer nip portion N1, so that image misregistration does not occur. Thereafter, with the fixing speed set equal to or lower than the transfer speed, the toner image is transferred onto the envelope, in which the occurrence of creases is suppressed, and fixed to the recording material. In the present exemplary embodiment, since the occurrence of creases is suppressed at the primary operation, there is no need for lowering the nip pressure at the heating nip portion N2 to suppress occurrence of creases, so that fixability is not lowered. Furthermore, such an operation is automatically performed by using the reversing conveyance mechanism R to save time and effort of the user, and effectively suppress the occurrence of creases in the envelope.

In the experiment that was conducted to confirm such an effect, creases did not occur in an envelope in a case where an image is formed on the envelope in a manner similar to that in the present exemplary embodiment. In a case where an image is formed on an envelope in the mode similar to a mode for the plain paper, creases occurred to the envelope.

Figure 4:
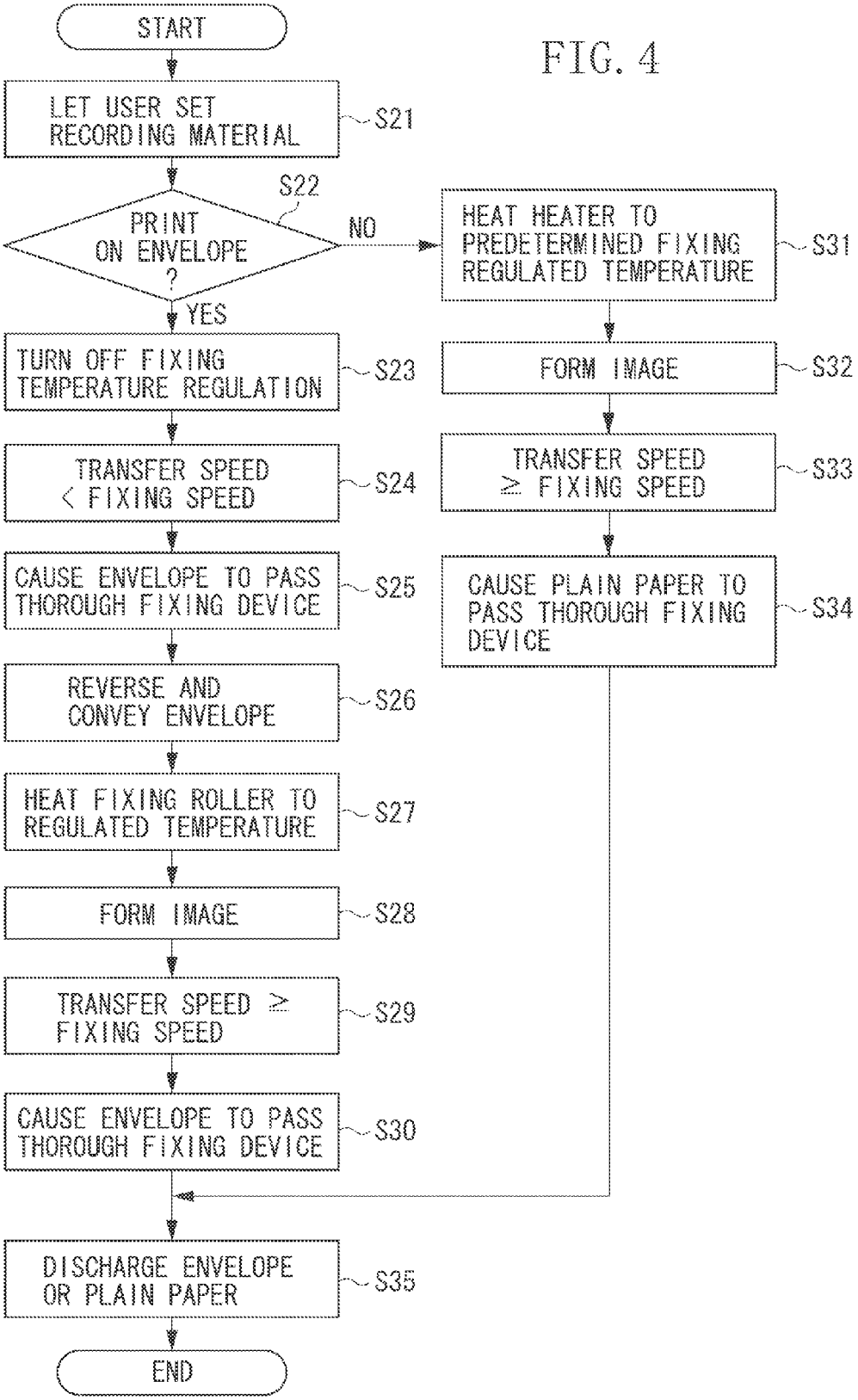
FIG. 4 is a flow chart illustrating an example of flow of control according to a second exemplary embodiment.

A second exemplary embodiment is described with reference to FIGS. 1, 2, and 4. In the present exemplary embodiment, a first temperature of the fixing roller 30*a* in a case where an envelope on which the toner image is not formed and which acts as a predetermined recording material is conveyed at the heating nip portion N2 is set lower than a second temperature of the fixing roller 30*a* in a case where the toner image is fixed to the envelope at the heating nip portion N2. In other words, in the envelope mode, the envelope passes through the fixing device A, whose temperature is set lower than regulated temperature in a case where toner is normally fixed, while being pulled between the transfer nip portion N1 and the heating nip portion N2. After that, the surface of the envelope is reversed by the reversing conveyance mechanism R and the envelope is fed again. As is the case with the normal image formation, the toner image is formed and fixed at a normal regulated temperature and without the envelop being pulled between the transfer nip portion N1 and the heating nip portion N2.

A specific example of such control is described below with reference to FIG. 4. In step S21, the user selects either of the modes in which plain paper or an envelope passes, using an operation unit (not illustrated).

In the plain paper mode in which the plain paper passes (NO in step S22), in step S31, the temperature control unit 102 heats the heater to a predetermined fixing regulated temperature at print start. In step S32, image formation is started when the predetermined temperature is reached. In step S33, the control portion C sets the fixing speed at the heating nip portion N2 equal to or lower than the transfer speed at the transfer nip portion N1. The fixing speed is set lower by 1.5% than the transfer speed. In step S34, the plain paper onto which the toner image is transferred at the transfer nip portion N1 is conveyed to the fixing device A which is rotationally driven at the fixing speed slower than the transfer speed at the transfer nip portion N1, and the transferred toner image is heated and pressed to be fixed. In step S35, the plain paper to which the toner image is fixed is discharged to the discharge tray 13 by the discharge roller pair 12.

In the envelope mode (the crease suppression mode) in which the envelope passes, in step S21, the user sets the envelope to the image forming apparatus 1 so that a non-print surface is set to be a normal print surface, which sets the recording material. If the envelope is set (YES in step S22), in step S23, the temperature control unit 102 turns off the halogen heater 34 at print start and does not perform fixing temperature regulation. Image formation is not performed either. For this reason, the first temperature of the fixing roller 30*a* at this point is lower than the second temperature at which the toner image is fixed. In step S24, the control portion C sets the fixing speed higher than the transfer speed.

If a surface temperature of the fixing roller 30*a* is less than 100° C., the opening of the front and back surfaces due to the generation of vapor in the envelope can be suppressed, which brings about an effect equivalent to that in the case where the surface temperature is at the room temperature. Therefore, the first temperature has only to be set lower than the second temperature and less than 100° C., or may be regulated to about 90° C., for example, without the halogen heater 34 being turned off. This can shorten the time required until the temperature of the fixing roller 30*a* for fixing the toner image thereafter is raised to a predetermined fixing temperature. The first temperature is desirably set to 80° C. or higher, or, more desirably, to 90° C. or higher and less than 100° C.

The first temperature may be 100° C. or higher and only has to be lower than the second temperature. In other words, the higher the temperature, the more easily the passing envelope shrinks due to heat, and, depending on that, the more easily creases occur. Consequently, the lower the temperature, the less the shrinkage due to heat, and the harder creases are to occur. For this reason, setting the first temperature lower than the second temperature brings about an effect of suppressing the occurrence of creases.

In step S25, in such a setting state, the envelope to which the toner image is not transferred passes through the fixing device A, which is in a non-heating state. Since the fixing speed is higher than the transfer speed, the envelope is conveyed while being pulled between the transfer nip portion N1 and the heating nip portion N2. Thus, the envelop passes through the fixing device A while being pulled to correct distortion on the front and back surfaces of the envelope, which suppresses the occurrence of creases. Furthermore, setting the surface temperature of the fixing roller 30*a* lower than the temperature at which the toner is fixed increases an effect of suppressing the occurrence of creases. At this point, the toner image is not transferred onto the envelope at the transfer nip portion N1, so that image misregistration is not caused.

At this point, a rub effect releases air from the envelope, pressed by the fixing device A and passed therethrough, and presses a fold line to bring the front and back surfaces into close contact with each other. If the corner of the envelope is deformed, it is corrected. Thereafter, in step S26, the surface of the envelope is reversed by the reversing conveyance mechanism R and the envelope is fed again to the transfer nip portion N1. Similarly to the case with the plain paper, in step S27, the fixing roller 30*a* is heated to the regulated temperature of the envelope. In step S28, image formation is started when the predetermined temperature is reached, similarly to the case with the plain paper. In step S29, the fixing speed is set equal to or lower than the transfer speed at the transfer nip portion N1. The fixing speed is set lower by 1.5% than the transfer speed. In step S30, the envelope to which the toner image is transferred at the transfer nip portion N1 is conveyed to the fixing device A which is rotationally driven at the fixing speed slower than the transfer speed, and the transferred toner image is heated and pressed to be fixed. At this point, the envelope has been rubbed during passing through the fixing device A in the primary operation, which suppresses the occurrence of creases. In step S35, the envelope to which the toner image is fixed is discharged to the discharge tray 13 by the discharge roller pair 12.

Thus, the temperature of the fixing roller 30*a* is set lower than the temperature, at which the toner image is fixed, when the envelope passes through the heating nip portion N2 in the envelop mode in the primary operation to enable suppression of the opening of the front and back surfaces due to the generation of vapor in the envelope, which more surely suppresses the occurrence of creases. Also in the present exemplary embodiment, when printing was performed on the envelope, creases did not occur in the envelope. However, when printing was performed on the envelope in the normal mode, as in the case with the plain paper, creases occurred in the envelope. Other structures and actions are similar to those of the first exemplary embodiment.

Figure 5:
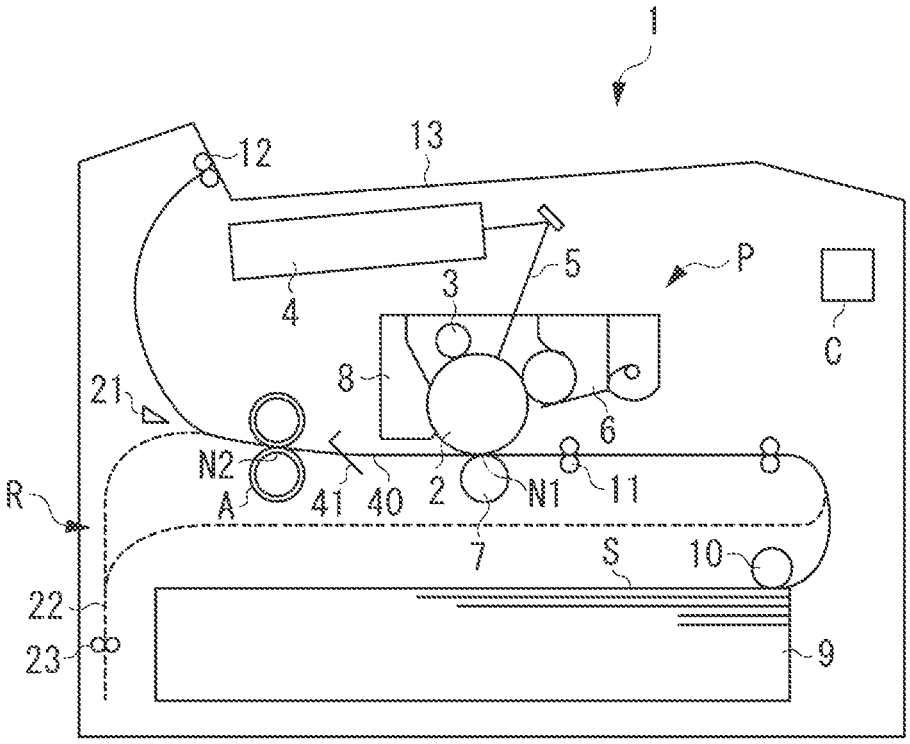
FIG. 5 is a cross section illustrating a schematic configuration of an image forming apparatus according to a third exemplary embodiment.

A third exemplary embodiment is described with reference to FIGS. 5 and 6A and 6B. The present exemplary embodiment is different from the first and second exemplary embodiments in that a protrusion member 41 acting as a hooking member is provided on a conveyance path 40 of the recording material between the transfer nip portion N1 and the heating nip portion N2 as illustrated in FIG. 5. The components that are overlapped with the first and second exemplary embodiments are given the same reference numerals not to repeat or to simplify the description thereof. The portions different from those in the first and second exemplary embodiments are described below.

Figure 6A:
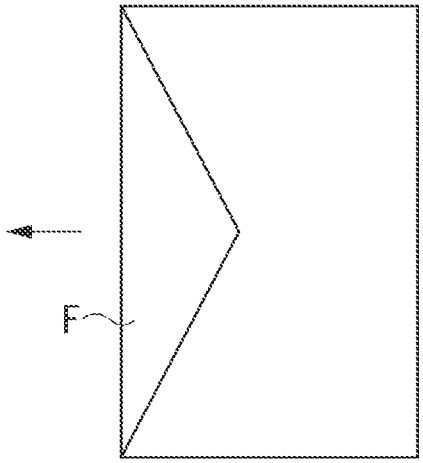
FIGS. 6A and 6B illustrate two examples of shape of envelopes.
Figure 6B:
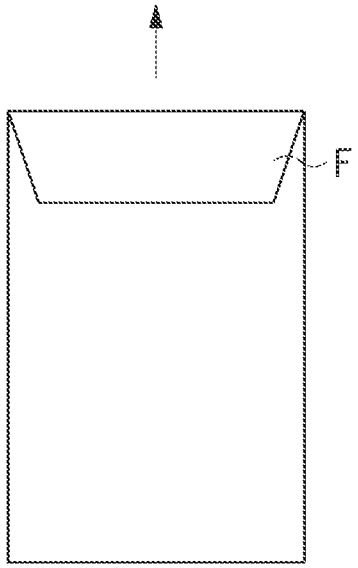

As illustrated in FIGS. 6A and 6B, a reclosable flap portion F is formed on a part of a bag-like body, such as an envelope. If the envelope is heated by the fixing device A with the flap portion F closed, vapor generated in the envelope at the heating is retained therein and creases are liable to occur in the envelope. In a case of a configuration, as the present exemplary embodiment, in which the envelope is conveyed again by the reversing conveyance mechanism R, the envelope is set so that the flap portion F is placed on the leading edge side of the conveyance direction at the time of the first conveyance with the flap portion F closed. The reason the flap portion F is closed is that, if the flap portion F is kept open, when the flap portion F lies in the leading edge of the conveyance direction, paper jam is liable to occur at the nip portion of the conveyance roller pair, the transfer nip portion N1, and the heating nip portion N2.

For this reason, the present exemplary embodiment has the following configuration. There is provided the protrusion member 41, acting as a mechanism (a hooking member), that is arranged on the conveyance path 40 to be able to advance to and retract from the side opposite the surface of the envelope on which the toner image is formed, and that opens the flap portion F of the envelope being conveyed with the flap portion F located at the trailing edge.

The conveyance path 40 includes a pair of guide plates and conveys a recording material such as an envelope between the pair of guide plates. In the present exemplary embodiment, a notch is formed on a guide plate arranged below in FIG. 5 out of the pair of guide plates and the protrusion member 41 is provided to be able to advance to and retract from the conveyance path 40 through the notch. The protrusion member 41 is made of resin and the leading edge thereof is bent to easily catch the flap portion F of the envelope being conveyed along the conveyance path 40. A drive unit such as a motor or cam (not illustrated) enables the protrusion member 41 to advance to and retract from the conveyance path 40. A conventional sensor flag which is arranged on the conveyance path and detects paper jam may be used as the protrusion member 41.

FIGS. 6A and 6B illustrate the shape of a typical envelope. As illustrated in FIG. 6A, the flap portion F may be provided on the long side of a rectangular envelope. As illustrated in FIG. 6B, the flap portion F may be provided on the short side of a rectangular envelope. In the present exemplary embodiment, when an image is formed on the envelope, the envelope is placed so that the flap portion F is taken as the leading edge in the conveyance direction i.e., in the direction indicated by arrows in FIGS. 6A and 6B, with the portion F closed. In this state, the user sets the envelope on the image forming apparatus 1 such that a non-print surface can be a normal print surface, in other words, an image formation surface is on the side opposite the side where an image is to be transferred when the recording material first passes. In the envelope illustrated in FIG. 6A, if the upward and downward directions in the figure are taken as a conveyance direction, the envelope may be placed with the portion F opened.

The envelope placed as described above is conveyed to the transfer nip portion N1 with the portion F taken as the leading edge as it is. At this point, the protrusion member 41 is retracted from the conveyance path 40. The fixing speed at the heating nip portion N2 is set higher than the transfer speed at the transfer nip portion N1. In this state, the envelope passes through the transfer nip portion N1 without the toner image being transferred. The envelop is conveyed along the conveyance path 40 without being caught by the protrusion member 41, and passes through the fixing device A in the non-heating state while being pulled between the transfer nip portion N1 and the heating nip portion N2.

After that, the envelope reversed by the reversing conveyance mechanism R is conveyed to the transfer nip portion N1 with the flap portion F located at the trailing edge in the conveyance direction. At this point, the fixing speed is set equal to or lower than the transfer speed. The protrusion member 41 advances to the conveyance path 40. Time is measured by a timer of the control portion C, and the protrusion member 41 advances to the conveyance path 40 before the trailing edge of the flap portion F reaches the place where the protrusion member 41 is arranged on the conveyance path 40 after the leading edge of the envelope reversed and conveyed passes the place.

When the surface temperature of the fixing roller 30*a* reaches a predetermined temperature, a normal image formation is conducted and the toner image is transferred onto the envelope at the transfer nip portion N1. The flap portion F at the trailing edge of the envelope having passed through the transfer nip portion N1 is caught by the protrusion member 41 having advanced to the conveyance path 40, and opens. In this state, the envelope passes through the fixing device, so that the toner image is fixed. Thus, the flap portion F is kept open at the trailing edge when the envelope passes through the fixing device A, in which the envelope is heated and pressed, to release vapor from the envelope generated in heating without the vapor being retained in the envelope, which can suppress the occurrence of creases in the envelope.

In the above description, the protrusion member is arranged on the conveyance path 40 between the transfer nip portion N1 and the heating nip portion N2, however, the protrusion member 41 may be placed as long as the protrusion member 41 is upstream of the heating nip portion N2 in the conveyance direction on the conveyance path of the recording material. In other words, the protrusion member 41 may be placed anywhere between the reversing conveyance mechanism R whereby to reverse the envelope and the fixing device A through which the envelope passes. Other structures and actions are similar to those of the first and second exemplary embodiments.

In the above exemplary embodiments, a unit configured to convey again the recording material to the transfer nip portion is formed by the reversing conveyance mechanism R, however, a mechanism for conveying the envelope again without reversing the envelope may be used. The crease suppression mode may be applied to other paper as well as the envelope.

While the present disclosure has been described with reference to exemplary embodiments, it is to be understood that these embodiments are not limiting. The scope of the following claims is to be accorded the broadest interpretation so as to encompass all such modifications and equivalent structures and functions.

This application claims the benefit of Japanese Patent Application No. 2012-213568 filed Sep. 27, 2012, which is hereby incorporated by reference herein in its entirety.

What is claimed is:

1. An image forming apparatus comprising:

an image forming unit configured to form an image on a recording material while the image forming unit nips and conveys the recording material at a first nip portion;

a fixing unit configured to fix the image formed on the recording material by the image forming unit while the fixing unit nips and conveys the recording material at a second nip portion;

a re-introduction unit configured to re-introduce the recording material, which has passed through the second nip portion, into the first nip portion; and a control unit configured to control an operation of the image forming unit and the fixing unit, wherein, if an envelope is used as the recording material, the control unit executes a primary operation in which the recording material is introduced to the first and second nip portions without the image forming unit forming an image on the envelope, and then executing a secondary operation in which the re-introduction unit re-introduces the envelope into the first and second nip portions and the image forming unit forms an image on the envelope, and wherein the control unit controls a conveyance speed of the envelope at the second nip portion to be set higher than the conveyance speed of the envelope at the first nip portion in the primary operation, and the control unit controls the conveyance speed of the envelope at the second nip portion to be set equal to or lower than the conveyance speed of the envelope at the first nip portion in the secondary operation.

2. The image forming apparatus according to claim 1, wherein the control unit controls the conveyance speed of the envelope at the second nip portion in the primary operation to be 1.1 times or less the conveyance speed of the envelope at the first nip portion.

3. The image forming apparatus according to claim 1, wherein the control unit controls the conveyance speed of the envelope at the second nip portion to be 1.01 times or more and 1.05 times or less the conveyance speed of the envelope at the first nip portion in the primary operation.

4. The image forming apparatus according to claim 1, wherein the control unit performs control so that the envelope held at the first and second nip portions does not loosen in the primary operation.

5. The image forming apparatus according to claim 1, wherein the envelope is re-introduced into the first and second nip portions so that a flap portion of the envelope is located at a trailing edge in a conveyance direction in the secondary operation.

6. The image forming apparatus according to claim 5, further comprising a mechanism configured to open the flap portion of the envelope before the envelope is re-introduced into the second nip portion after the primary operation is performed.

7. The image forming apparatus according to claim 6, wherein the mechanism is retractable from a conveyance path for the recording material.

8. The image forming apparatus according to claim 1, wherein the control unit controls a temperature of the fixing unit in the primary operation to be set lower than the temperature of the fixing unit in the secondary operation.

9. The image forming apparatus according to claim 1, wherein the image forming unit includes a first rotating-body pair forming the first nip portion and the fixing unit includes a second rotating-body pair forming the second nip portion.

10. An image forming apparatus comprising:

an image forming unit configured to form an image on a recording material while the image forming unit nips and conveys the recording material at a first nip portion;

a fixing unit configured to fix the image formed on the recording material by the image forming unit while the fixing unit nips and conveys the recording material at a second nip portion;

a re-introduction unit configured to re-introduce the recording material, which has passed through the second nip portion, into the first nip portion; and a control unit configured to control an operation of the image forming unit and the fixing unit, wherein, if an envelope is used as the recording material, the control unit executes a primary operation in which the recording material is introduced to the first and second nip portions without the image forming unit forming an image on the envelope, and then executing a secondary operation in which the re-introduction unit re-introduces the envelope into the first and second nip portions and the image forming unit forms an image on the envelope, and wherein the control unit performs controls so that the envelope held at the first and second nip portions does not substantially loosen in the primary operation and that the envelope held at the first and second nip portions produces a predetermined looseness in the secondary operation.

11. The image forming apparatus according to claim 10, wherein the envelope is re-introduced into the first and second nip portions so that a flap portion of the envelope is located at a trailing edge in a conveyance direction in the secondary operation.

12. The image forming apparatus according to claim 11, further comprising a mechanism configured to open the flap portion of the envelope before the envelope is re-introduced into the second nip portion after the primary operation is performed.

13. The image forming apparatus according to claim 12, wherein the mechanism is retractable from a conveyance path for the recording material.

14. The image forming apparatus according to claim 10, wherein the control unit controls a temperature of the fixing unit in the primary operation to be set lower than the temperature of the fixing unit in the secondary operation.

15. The image forming apparatus according to claim 10, wherein the image forming unit includes a first rotating-body pair forming the first nip portion and the fixing unit includes a second rotating-body pair forming the second nip portion.

* * * * *